US006823901B1

(12) United States Patent
Garcia

(10) Patent No.: US 6,823,901 B1
(45) Date of Patent: Nov. 30, 2004

(54) WELDING CHAIN LINK WEAVING MACHINE AND METHOD

(75) Inventor: Jose G. Garcia, La Puente, CA (US)

(73) Assignee: BMCI, Inc., South El Monte, CA (US)

( * ) Notice: Subject to any disclaimer, the term of this patent is extended or adjusted under 35 U.S.C. 154(b) by 2 days.

(21) Appl. No.: 10/165,486

(22) Filed: Jun. 7, 2002

(51) Int. Cl.[7] ..... B21F 27/14
(52) U.S. Cl. ..... 140/92.7; 140/24
(58) Field of Search ..... 140/24, 92.7, 112; 245/10

(56) References Cited

U.S. PATENT DOCUMENTS

| | | | | |
|---|---|---|---|---|
| 444,753 | A | 1/1891 | Kitselman | |
| 889,815 | A | 6/1908 | Schmid | |
| 991,542 | A | 5/1911 | Roehrich | |
| 1,005,480 | A | 10/1911 | Schmid | |
| 1,243,353 | A | 10/1917 | Snedeker | |
| 1,259,378 | A | 3/1918 | Doring | |
| 1,811,511 | A | 6/1931 | Mafera | |
| 1,847,155 | A | 3/1932 | Williams | |
| 1,885,361 | A | 11/1932 | Land | |
| 2,202,442 | A | 5/1940 | Blashill | 140/8 |
| 2,447,155 | A | 8/1948 | Brickman | 140/1 |
| 2,843,160 | A | 7/1958 | Blashill | 140/92.3 |
| 3,144,887 | A | 8/1964 | Bergandi et al. | 140/92.6 |
| 3,388,725 | A | 6/1968 | Richardson | 140/93 |
| 3,601,163 | A | 8/1971 | Ellis | 140/92.7 |
| 3,722,554 | A | 3/1973 | Vanderfaeillie | 140/115 |
| 4,513,793 | A | 4/1985 | Rohrbacher | 140/92.4 |
| 4,566,501 | A | 1/1986 | Rohrbacher | 140/1 |
| 4,572,249 | A | 2/1986 | Lange | 140/92.6 |
| 5,592,978 | A | 1/1997 | Garcia et al. | 140/92.94 |
| 5,785,097 | A | 7/1998 | Garcia | 140/92.7 |
| 5,908,052 | A | 6/1999 | Garcia | 140/92.7 |

*Primary Examiner*—Lowell A. Larson
(74) *Attorney, Agent, or Firm*—Sheppard, Mullin, Richter & Hampton LLP

(57) ABSTRACT

Chain link material for use in fences and other various applications are formed with flattened end portions so as to improve the handling and safety characteristics thereof. The flattened end portions of the chain link fence are formed by bending, trimming, welding together and then painting cut ends of the wire forming the chain link material. This bending, trimming, welding and painting is performed in a series of assemblies held on one or both sides of a chain link material being indexed through a weaving machine. The series of assemblies are moveable into and out of contact with the cut ends of the wires in the chain link material so as to bend, trim, weld together and paint the welded together ends.

18 Claims, 5 Drawing Sheets

WELDING CHAIN LINK WEAVING MACHINE AND METHOD

BACKGROUND OF THE INVENTION

1. Field of the Invention

This invention relates generally to a chain link weaving machine, and more particularly, to an improved chain link weaving machine including components for bending, trimming, welding and painting flattened top and/or bottom ends of chain link material formed thereon.

2. Description of Related Art

Chain link fence, and weaving machines for making the same, are well known in the art. Companies such as BMCI, Inc., dba Bergandi Machinery Company of South El Monte, Calif., manufacture and sell various types of chain link weaving machines. In the known Bergandi Machines, two strands of wire from two large coils of wire are continuously fed onto a forming mechanism (weaving blade), so that two needles at a time are formed into a picket in an intercoiled manner and then woven by a trough weaving mechanism to form continuous links of chain link.

After being woven together, the just woven picket is cut off at the ends, and a wire fabric of open construction is formed having sharp, cut ends. The formed wire fabric is then indexed through the machine to a point along the top thereof where selvage is performed. This selvage normally is accomplished by turret knucklers which form knuckles by bending over the sharpened ends thereof, or other turret mechanisms to twist the ends and form sharp barbs thereon.

These barbed or knuckled ends formed on the chain link fabric are then utilized as the top and bottom of the fabric when the fence is mounted on poles, or the open wire fabric may be used in furniture, land fill, mines, rock control, soil retention or other areas.

Such chain link fabric having knuckled or barbed ends, may be rolled into compacted form, i.e., wherein the diamonds formed in the chain link fabric are collapsed into each other so as to form a tighter roll of material. However, the knuckled or barbed ends of such compacted rolls become tangled and/or may be pulled apart when the roll is unwound.

Although there are known types of fence, such as gabion, which might have flattened tops or bottoms, this type of fence is more expensive and is of a lighter gauge than chain link fabric. Additionally, U.S. Pat. No. 5,785,097 ("'097") to Garcia discloses an apparatus and method for forming chain link fabric with flattened ends. In the Garcia '097 patent, the ends of the wire used to make such chain link fabric are first cut, then bent, then secured together at a single station to form both flat top and bottom portions on the chain link fabric.

Therefore, although the Garcia '097 patent described an apparatus that produces acceptable material and results, there still exists a need in the art for an apparatus and method that produces superior chain link material in an expeditious manner on a compact machine allowing unparalleled control and welding of chain link material, to produce butt-welded ends that are then painted to prevent corrosion.

SUMMARY OF THE INVENTION

It is, therefore, a general object of the present invention to provide chain link material having flattened, tangle-free top and/or bottom portions. It is a particular object of the present invention to provide an improved and simplified method for making chain link fabric with welded flattened ends. It is another particular object of the present invention to provide apparatus for bending, trimming, securing together and painting cut ends of woven chain link fence to form flattened, tangle-free ends thereon. It is a further particular object of the present invention to provide tangle-free, compactible chain link material that has its ends bent, trimmed, welded together and painted in an improved manner. And it is a still further object of the present invention to provide an improved machine to produce welded chain link material with flattened bottom and top ends, which flattened ends are bent, trimmed, butt-welded together and painted in a more accurate and controlled manner.

These and other objects of the present invention are achieved by providing apparatus for bending, trimming, welding together and painting cut ends of wire used in chain link material to form flattened ends on the chain link material. The bending, trimming, welding and painting of all the cut ends of the chain link material is performed at a series of stations on a top area of a simple, compact chain link fence weaving machine. The cut ends of the wire used in chain link material are indexed to a bender where it is first bent and then to a trimmer where the cut ends are trimmed to desired lengths by means brought into contact with the cut ends. The trimmed ends are then indexed to a welding station where the trimmed, bent ends are moved together and butt-welded. After welding, the welded ends are painted at a further station.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in conjunction with the accompanying drawings, in which:

DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide for a novel and improved, compact and simplified apparatus and method to form accurately welded chain link material having flattened ends.

Figure 1:
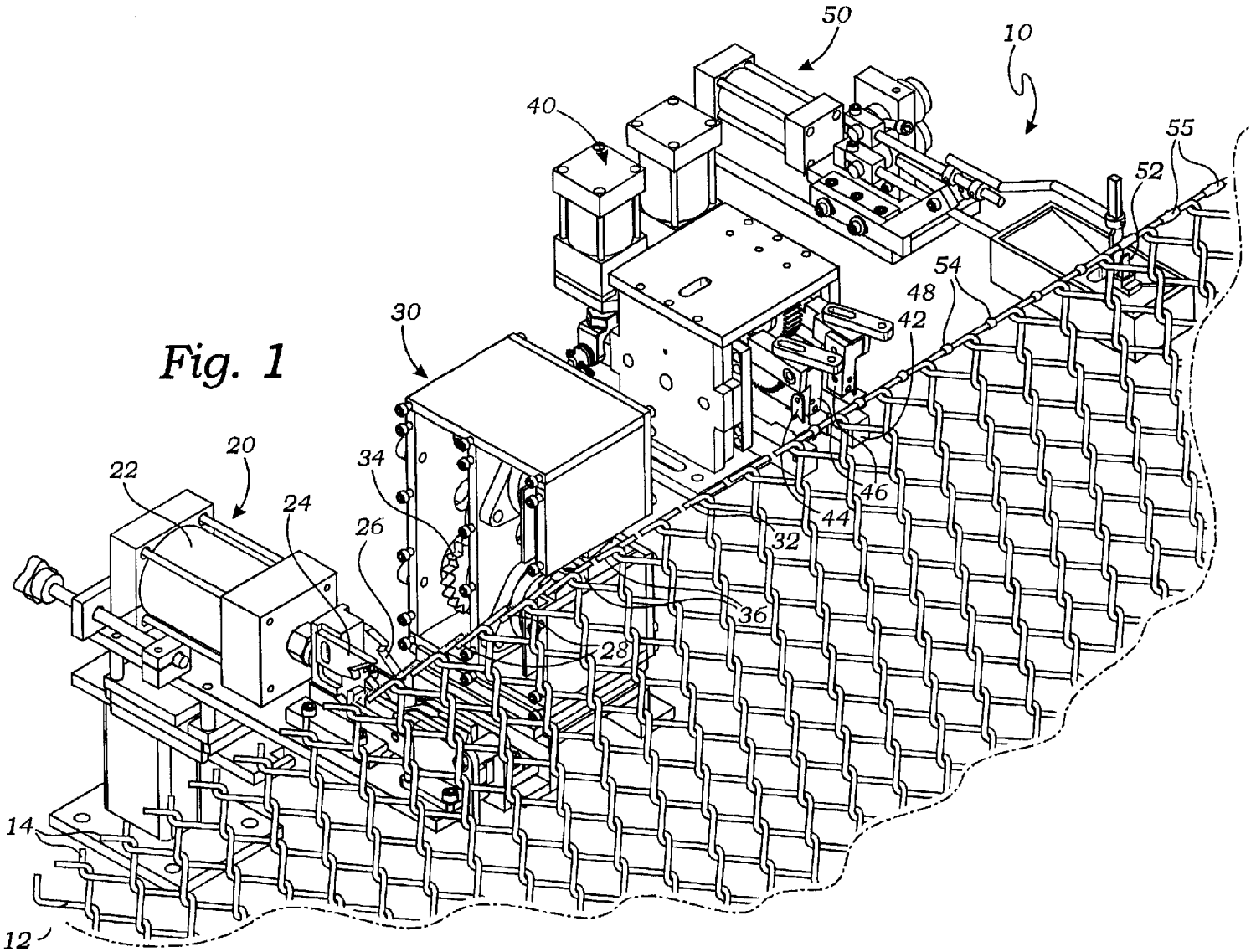
FIG. 1 is a partial perspective view showing four stations in a chain link fence weaving machine embodying the novel features of the present invention.

Referring now to FIG. 1 of the drawings, there shown is a schematic representation of the top of a chain link fence weaving machine 10 This weaving machine is of the so-called flat top type and has incorporated therein the various stages of the present invention on opposite sides of chain link material 12 as it exits from the wire weaver, although only one side of the machine is shown. The chain link weaving machine itself may be of the automatic two-wire type wherein wire from large coils of wire (not shown) are continuously fed into a coiling mechanism so that two wires at a time are intercoiled and then woven by a weaving mechanism to form continuous links of the chain link material 12. After weaving, the two wires just woven are cut by a cutting mechanism so that opposite ends 14 of the wires in the chain link material provide sharpened ends. The chain link material 12 is normally made from a galvanized steel, or the like, of sufficient gauge to provide a strong material which is generally resistant to weather. As in known machines, the material 12 with the freshly cut ends 14 is indexed through the machine. That is, in the present invention, the cut wire ends 14 are indexed through improved assemblies or stages to bend, trim, weld together and paint the bent ends to provide flattened tops and bottoms to the woven chain link material for wider use and better safety purposes.

The woven chain link material 12 exits from the wire weaving mechanism and is held in a stretched-out position as it passes over rollers 16 and 18 at the ends of the top of the machine.

Figure 2:
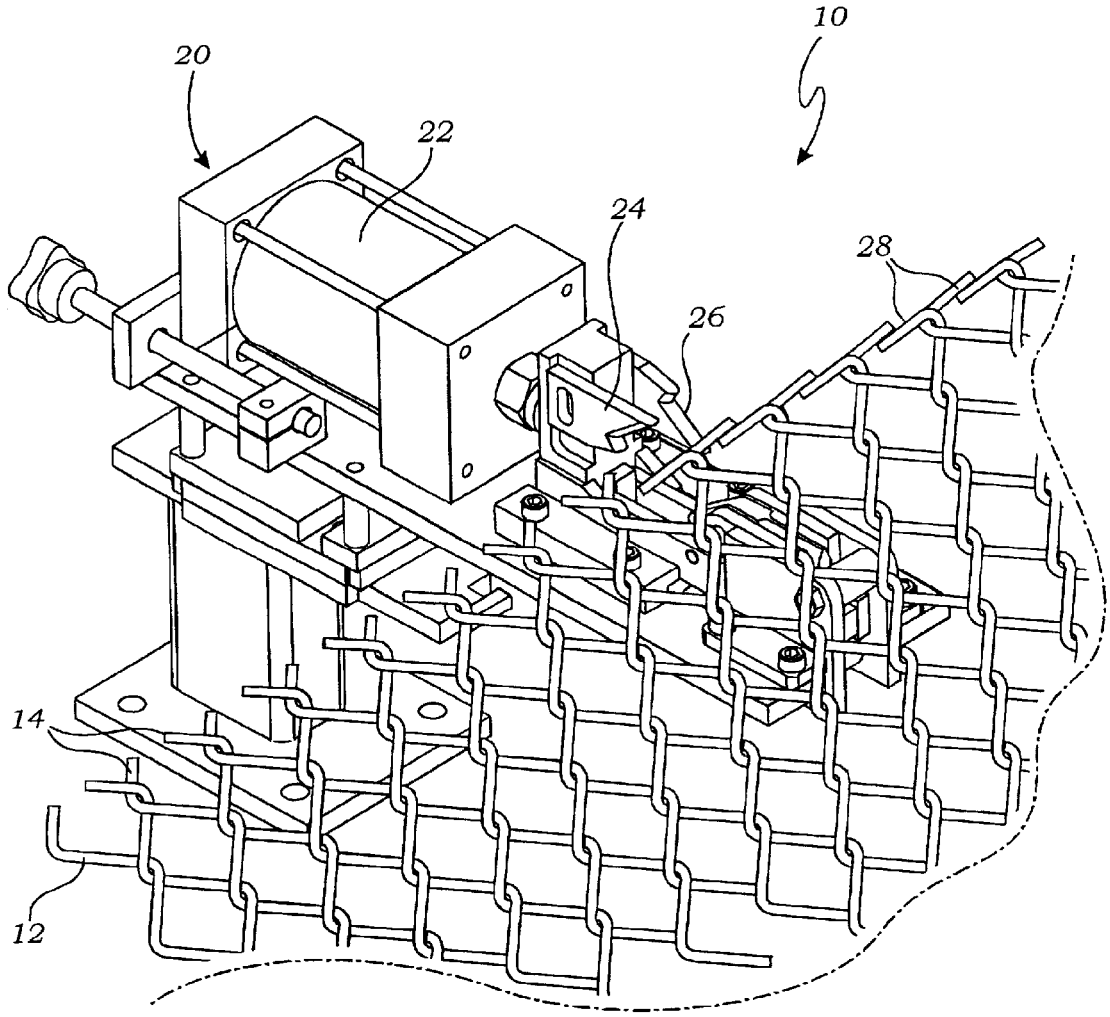
FIG. 2 is a schematic representation of a bender station of the present invention.

A first stage or bending station 20 is provided at both ends of the chain link material 12. Each of the bending stations is preferably pneumatically operated by a unit 22 to move blades 24, 26 against the ends 14, so as to bend the ends into aligned positions, as shown at 28 (see FIG. 2).

Figure 3:
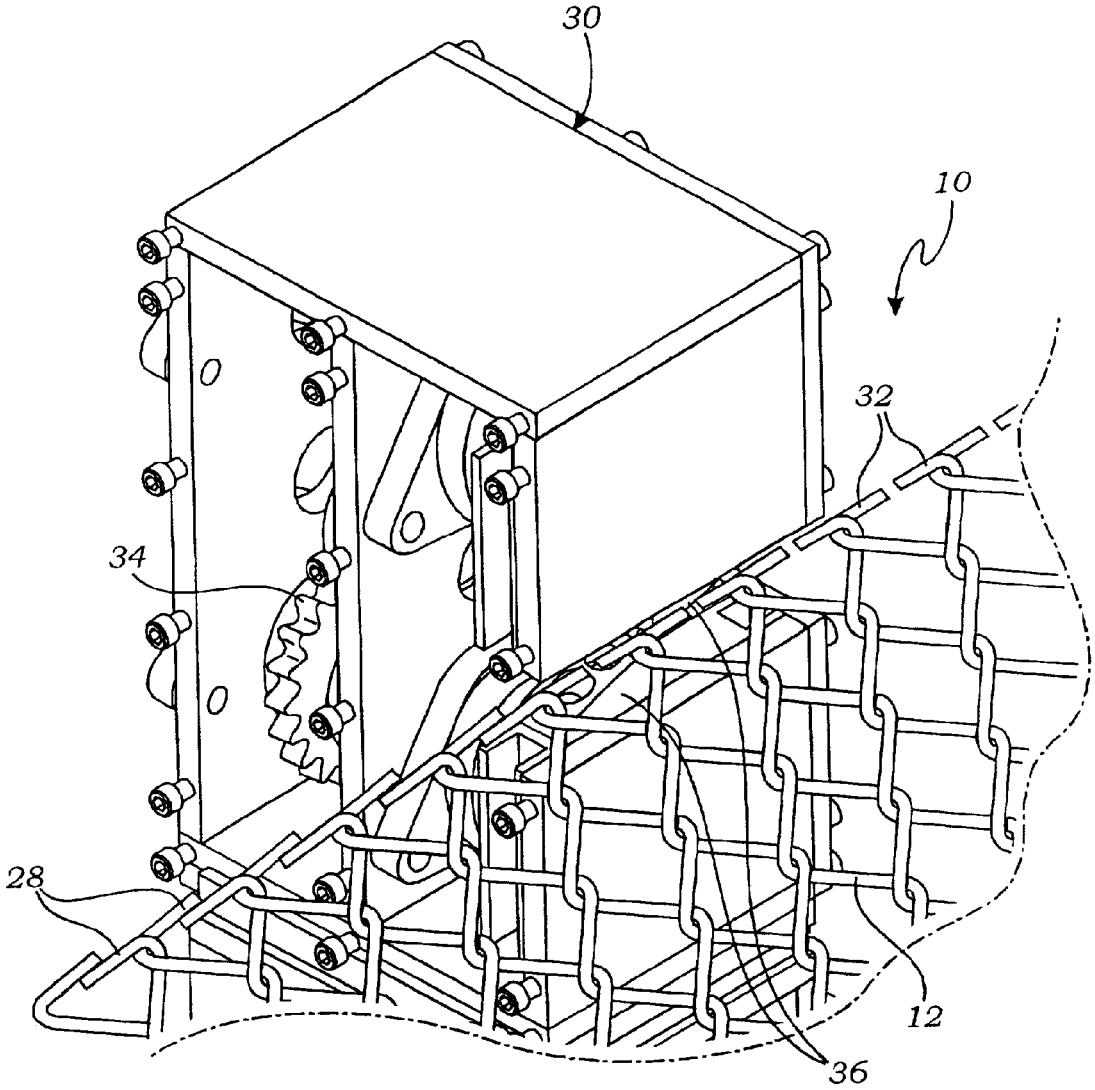
FIG. 3 is a schematic representation of a trimming station of the present invention.

After the ends 14 are bent into aligned positions 28, the chain link material is indexed to a second stage or trimming station 30 where the aligned wire ends 28 are trimmed flush, one to the other, so that they mate, as shown at 32. The trimming station 30 is preferably driven by a motor (not shown) to operate a plurality of gears and other elements 34, as needed, to operate trimming blades 36, to cut off and mate the aligned ends 28 to form mated ends 32 (see FIG. 3).

Figure 4:
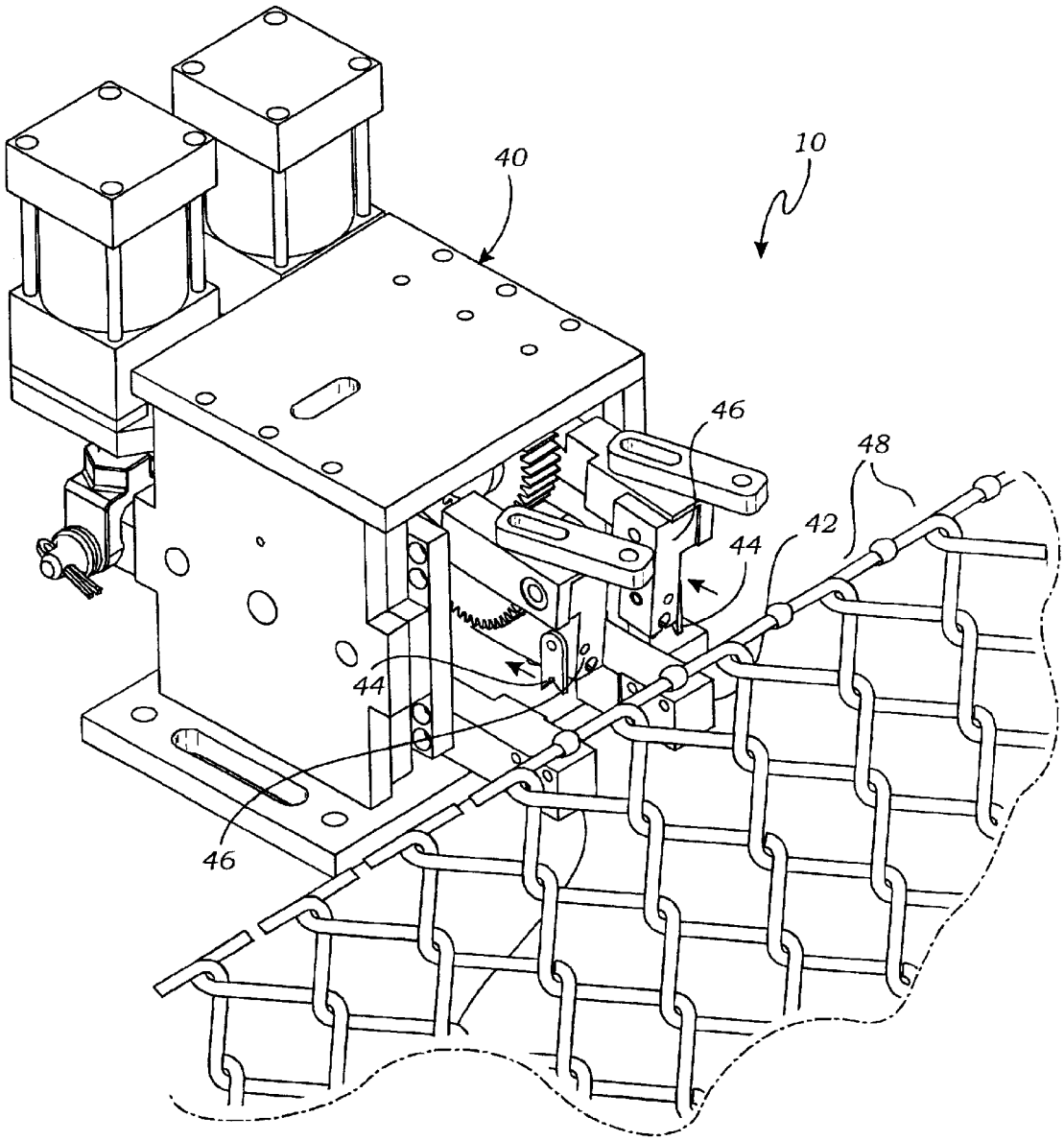
FIG. 4 is a schematic representation of a welding station for securing the bent and trimmed ends of the wires in the chain link material together.

After the ends are trimmed and mated by assembly 30, the chain link material is indexed to a third stage or welding station 40. At this station 40, the trimmed and mated ends 32 are butt-welded together (see FIG. 4), as follows: 1) clamps 42 are deployed, as by being moved toward the mated ends 32, to grab the mated wire ends; 2) fingers 44 drop to help align the mated wire ends 32; 3) the clamps 42 then shift toward each other to close any gap between the mated wire ends 32; 4) welding units 46 brought into contact with the mated wire ends 32 when the fingers 44 drop are actuated to butt-weld the mated wire ends together, as shown at 48. After the mated wire ends are welded, the clamps 42 are released, move away from each other and are raised to be ready for the next cycle.

Figure 5:
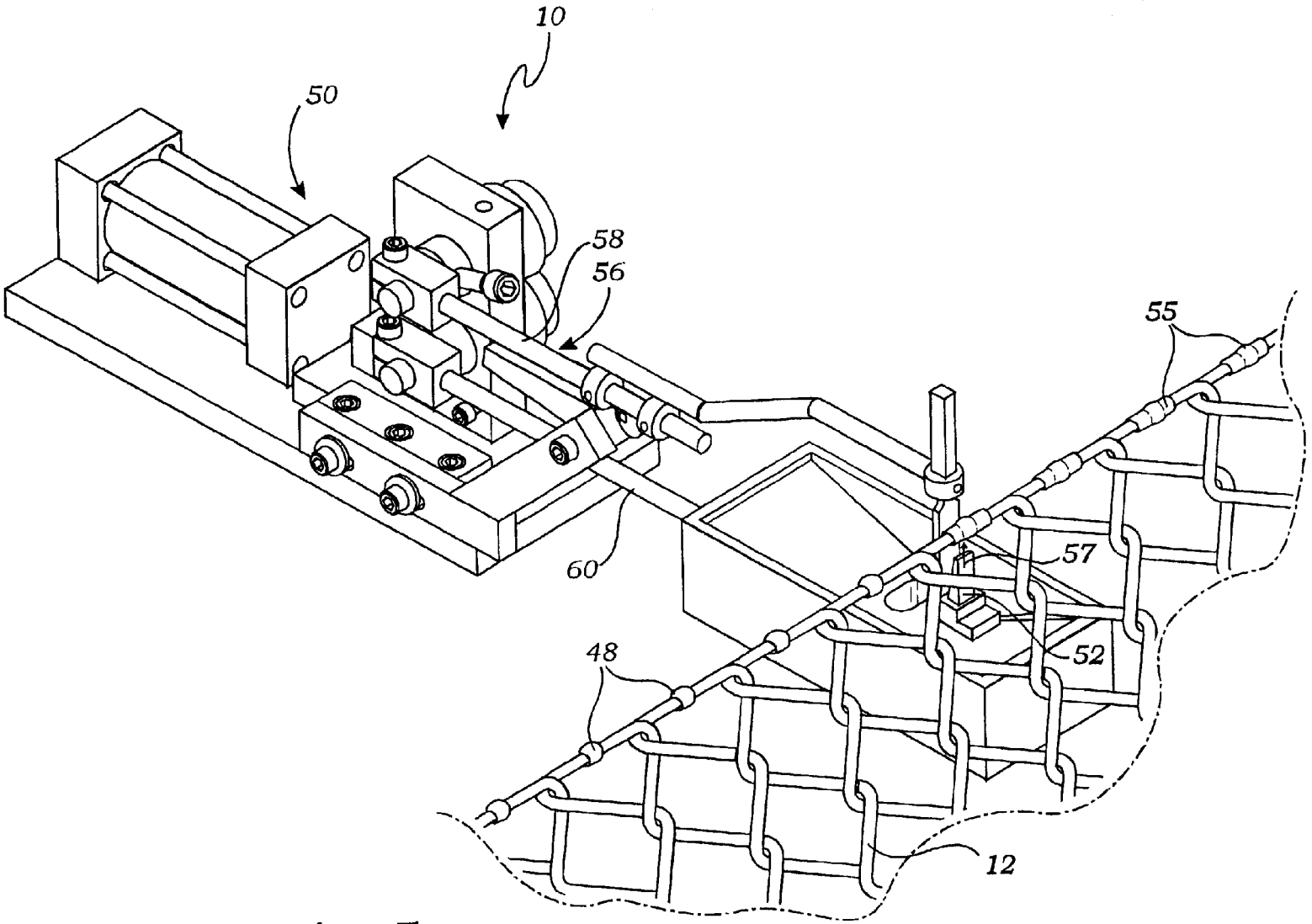
FIG. 5 is a schematic representation of a painting station for painting the welded portions of flattened end portions of the chain link material.

The chain link material 12 is then indexed to a fourth stage or paint station 50. At the paint station 50, the welded ends 48 are coated with a special paint in order to prevent corrosion and to match the paint-covered weld to the remainder of the chain link material 12. The paint station 50 includes a pair of pads 52, 54 for dabbing the welded-together ends to cover them with a predetermined amount of paint from above and below, as shown at 55. The pads are moved toward and away from the welded ends (see arrow 57 in FIG. 5) by actuation of a linkage system 56. A pump, not shown, delivers paint to the pads 52, 54 via conduits/pad holders 58, 60 or any other desired manner, in a controlled manner.

Thus, there has been described an improved apparatus and method for producing an improved product under unparallel control, namely, a chain link material having flattened, welded-together and painted ends. These flattened, welded and painted ends are tangle-free and will, therefore, not come apart during use. The flattened, welded and painted ends provide a more aesthetic and longer lasting chain link material that is adaptable for a wide range of uses.

Those skilled in the art will appreciate that various adaptations and modifications of the just-described preferred embodiments may be configured without departing from the scope and spirit of the invention. Therefore, it is to be understood that, within the scope of the appended claims, the invention may be practiced other than is specifically described herein.

What is claimed is:

1. A method of forming flattened end portions on a plurality of linked together chains in a chain link material comprising the steps of:

bending cut-off end portions into parallel, aligned portions;

trimming the parallel aligned portions of each chain so as to mate adjacent trimmed ends thereof;

welding mated, adjacent trimmed ends to form a flattened end assembly on the chain link material; and painting the welded, flattened end assembly.

2. An apparatus for forming flattened end portions on chain link material comprising:

means for bending and aligning adjacent, sharpened cut ends of chain link material at a first position after the forming of the chain link material by a wire weaver;

trimming means for cutting off and mating the bent and aligned, cut-off end portions of the chain link material at a second position;

welding means for welding the cut-off and mating end portions together at a third position so as to form welded-together, flattened end portions on the chain link fence; and painting means at a fourth position for painting the welded-together, flattened end portions.

3. The apparatus of claim 2 wherein the means for bending and aligning is a pair of blades movable into and out of contact with adjacent sharpened, cut ends.

4. The apparatus of claim 3 wherein the trimming means includes a plurality of blades that are brought into contact with the bent and aligned ends to form cut-off and mating ends.

5. The apparatus of claim 4 wherein the welding means includes a pair of clamps and a pair of welding elements for holding and welding together the cut-off and mating ends by a butt weld.

6. The apparatus of claim 5 wherein the painting means includes a pair of pads that are brought into contact with the butt-welded end portions.

7. The apparatus of claim 2 wherein the trimming means includes a plurality of blades that are brought into contact with the bent and aligned ends to form cut-off and mating ends.

8. The apparatus of claim 7 wherein the welding means includes a pair of clamps and a pair of welding elements for holding and welding together the cut-off and mating ends by a butt weld.

9. The apparatus of claim 8 wherein the painting means includes a pair of pads that are brought into contact with the butt-welded end portions.

10. The apparatus of claim 2 wherein the welding means includes a pair of clamps, a pair of alignment fingers and a pair of welding elements for holding and welding together the cut-off and mating ends by a butt weld.

11. The apparatus of claim 10 wherein the means for bending and aligning includes a pair of blades movable into and out of contact with sharpened, cut ends.

12. The apparatus of claim 11 wherein the trimming means includes a plurality of blades that are brought into contact with the bent and aligned ends to form cut-off and mating ends.

13. The apparatus of claim 2 wherein the painting means includes a pair of pads that are brought into contact with the welded end portions.

14. The apparatus of claim 13 wherein the means for bending and aligning is a pair of blades movable into and out of contact with sharpened, cut ends.

15. The apparatus of claim 14 wherein the trimming means includes a plurality of blades that are brought into contact with the bent and aligned ends to form cut-off and mating ends.

16. An apparatus for forming flattened, welded and painted end portions on chain link material, comprising:

a first station having a pair of movable blades for bending and aligning adjacent, sharpened ends of chain link material after the forming of the chain link material by a wire weaver;

a second station having a pair of movable trimming elements to cut off and mate the bent and aligned ends;

a third station having a pair of clamping elements and a pair of welding elements for butt-welding together the cut off and mated ends; and a fourth station having a pair of opposed paint pads, movable into and away from the butt-welded together ends to paint the butt-welded together ends.

17. The apparatus of claim 16 wherein there are two first stations, second stations, third stations and fourth stations on opposed sides of the chain link material so as to flatten, weld and paint both ends of the chain link material.

18. The apparatus of claim 17 wherein each of the third stations includes a pair of alignment fingers and the clamping elements are movable toward and away from each other.

* * * * *